US009708751B2

(12) United States Patent
Bae et al.

(10) Patent No.: US 9,708,751 B2
(45) Date of Patent: Jul. 18, 2017

(54) CLOTHES DRYER PROVIDED WITH SCENT-SUPPLY MODULE IN A TOP PLATE

(75) Inventors: Sang-Hun Bae, Gyeongsangnam-Do (KR); Min-Ji Kim, Gyeongsangnam-Do (KR); Chul-Jin Choi, Gyeongsangnam-Do (KR)

(73) Assignee: LG ELECTRONICS INC., Seoul (KR)

( * ) Notice: Subject to any disclaimer, the term of this patent is extended or adjusted under 35 U.S.C. 154(b) by 1031 days.

(21) Appl. No.: 12/997,964

(22) PCT Filed: Aug. 7, 2009

(86) PCT No.: PCT/KR2009/004425
§ 371 (c)(1),
(2), (4) Date: Dec. 14, 2010

(87) PCT Pub. No.: WO2010/016748
PCT Pub. Date: Feb. 11, 2010

(65) Prior Publication Data

US 2011/0113642 A1 May 19, 2011

Related U.S. Application Data

(60) Provisional application No. 61/086,843, filed on Aug. 7, 2008, provisional application No. 61/086,847, filed
(Continued)

(30) Foreign Application Priority Data

Aug. 7, 2008 (KR) ..... 10-2008-0077543
Aug. 7, 2008 (KR) ..... 10-2008-0077546
Aug. 7, 2008 (KR) ..... 10-2008-0077554

(51) Int. Cl.
*D06F 58/20* (2006.01)

(52) U.S. Cl.
CPC ..... *D06F 58/203* (2013.01)

(58) Field of Classification Search
CPC ..... D06F 58/203; C11D 3/50
(Continued)

(56) References Cited

U.S. PATENT DOCUMENTS 2,629,514 A * 2/1953 Savolainen ..... 220/314
3,718,238 A * 2/1973 Hazard ..... B65D 47/305 222/536
(Continued)

FOREIGN PATENT DOCUMENTS

CN 1614118 5/2005
JP 06099973 A * 4/1994
(Continued)

*Primary Examiner* — Jiping Lu
(74) *Attorney, Agent, or Firm* — Dentons US LLP

(57) ABSTRACT

A clothes dryer comprises a body, a top plate disposed on upper part of the body, a drum rotatably installed in the body, a front supporter and a rear supporter configured to support the drum, and a fragrance supplying module mounted at the top plate, and configured to supply fragrance into the drum, wherein a sealing device configured to prevent fragrance from being dispersed to outside is provided at an inlet unit of the fragrance supplying module through which a fragrant liquid is introduced. The sealing device is implemented as a protrusion having a ring shape and formed on an inner surface of the cover which opens and closes a chamber of a fragrance supplying device. By this sealing device, fragrance stored in the chamber may be prevented from being dispersed to outside.

2 Claims, 5 Drawing Sheets

Related U.S. Application Data on Aug. 7, 2008, provisional application No. 61/136, 024, filed on Aug. 7, 2008.

(58) Field of Classification Search
USPC ..... 34/597, 603; 220/526, 203.25, 221, 361
See application file for complete search history.

(56) References Cited

U.S. PATENT DOCUMENTS

| | | | | |
|---|---|---|---|---|
| 4,642,908 | A | 2/1987 | Brenner | |
| 7,234,480 | B2 * | 6/2007 | Whaley | 137/15.18 |
| 8,201,345 | B2 * | 6/2012 | Dalton et al. | 34/389 |
| 2003/0136692 | A1 * | 7/2003 | Hung | 206/324 |
| 2009/0272004 | A1 * | 11/2009 | Chernetski et al. | 34/389 |

FOREIGN PATENT DOCUMENTS

| | | | |
|---|---|---|---|
| JP | 2007-068870 | | 3/2007 |
| KR | 10-2006-0001240 | A | 6/2004 |
| KR | 10-0587330 | | 6/2006 |
| KR | 10-2007-0037127 | A | 4/2007 |
| KR | 10-0765278 | | 10/2007 |
| KR | 10-0799994 | B1 | 1/2008 |
| KR | 10-2008-0056627 | | 6/2008 |
| WO | WO 2008/075849 | | 6/2008 |

* cited by examiner

[Fig. 1]
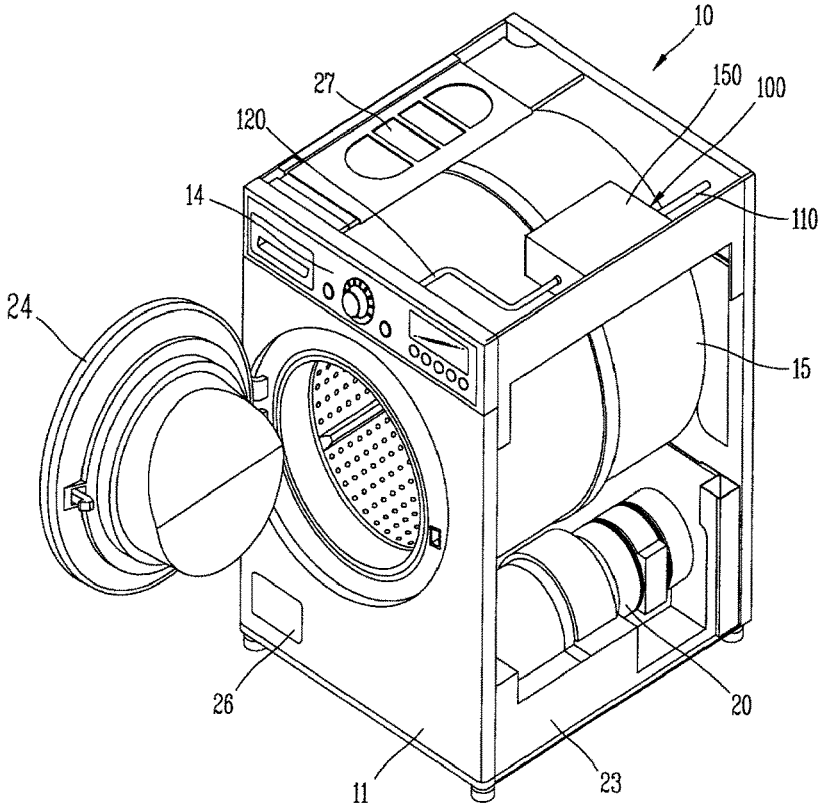
[Fig. 2]
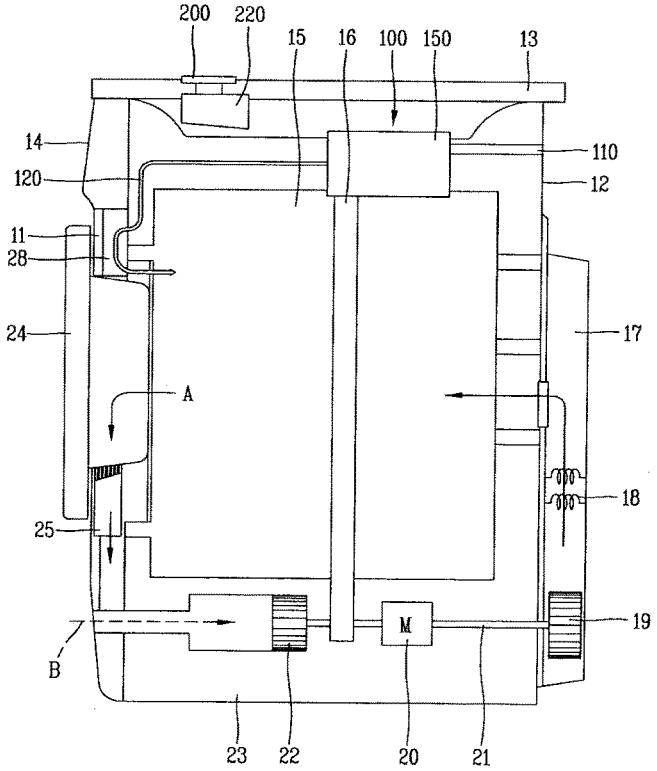

[Fig. 3]
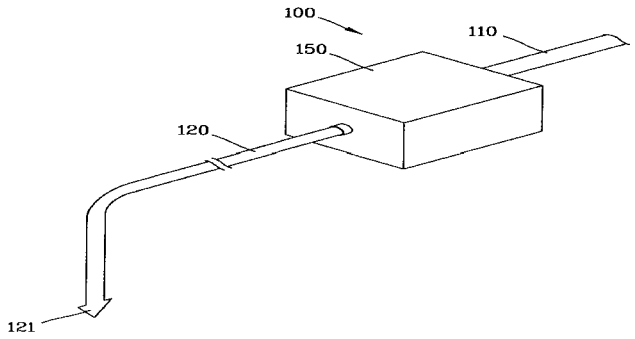
[Fig. 4]
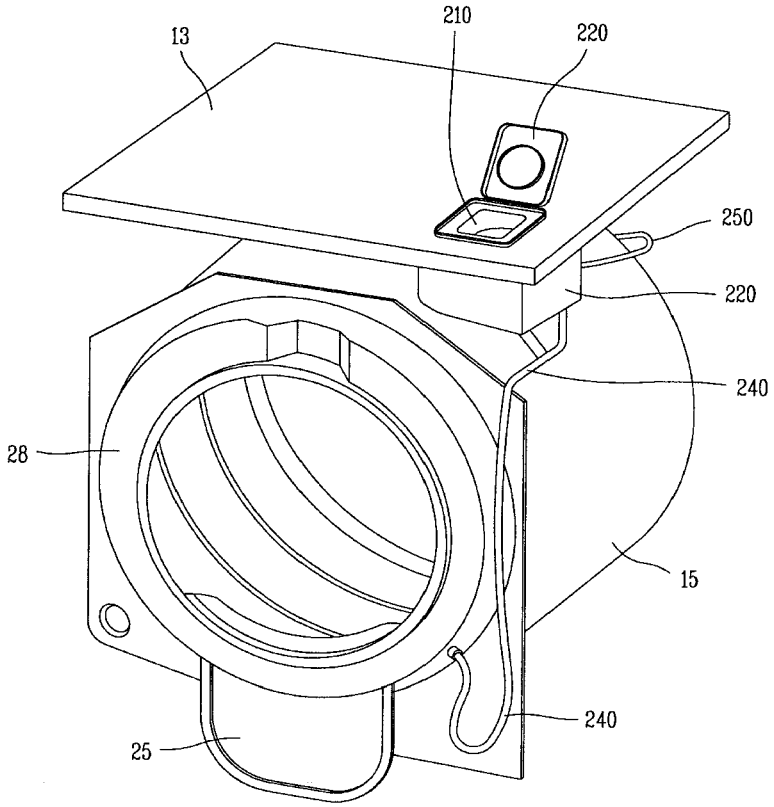

[Fig. 5]
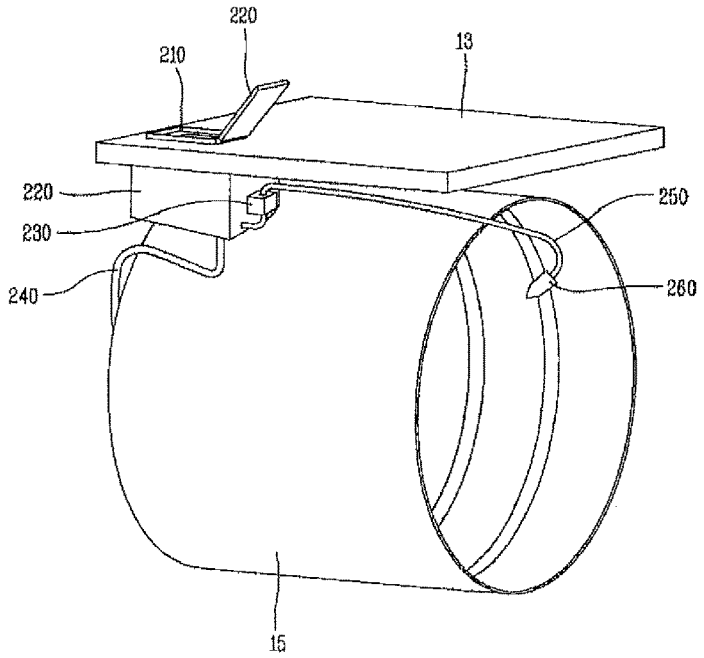
[Fig. 6]
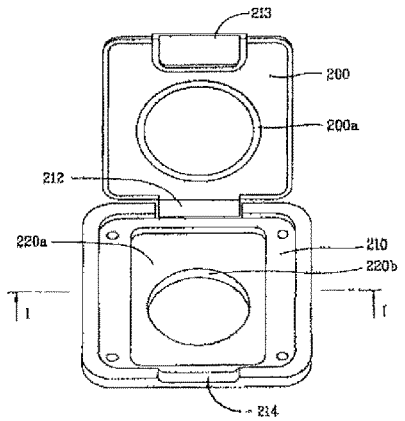
[Fig. 7]
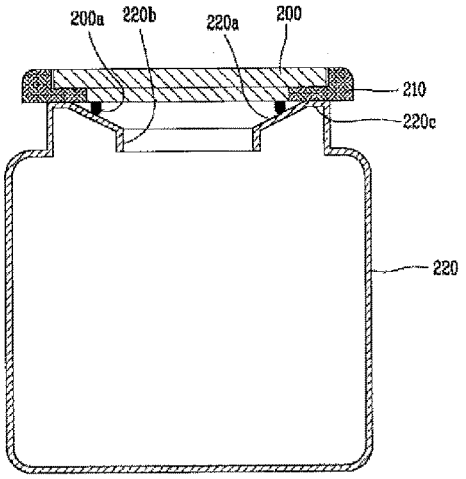

[Fig. 8]
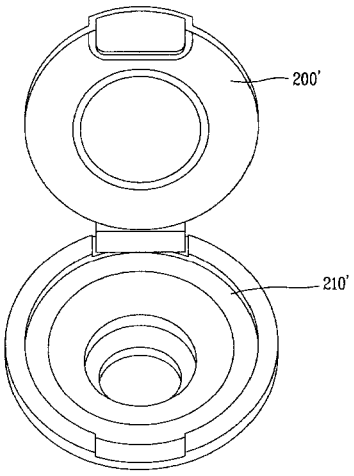
[Fig. 9]
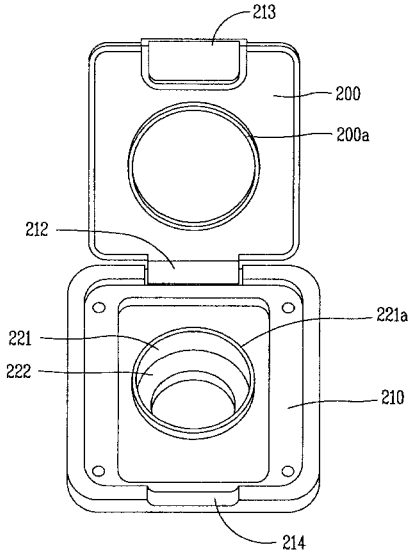
[Fig. 10]
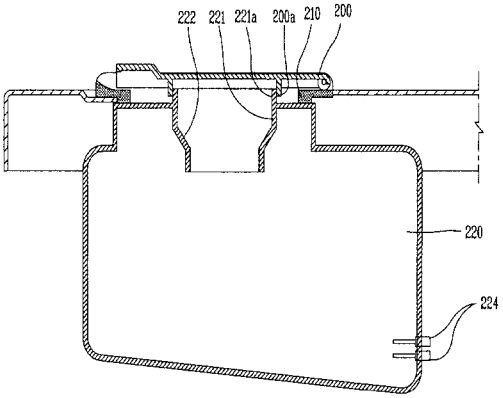

[Fig. 11]
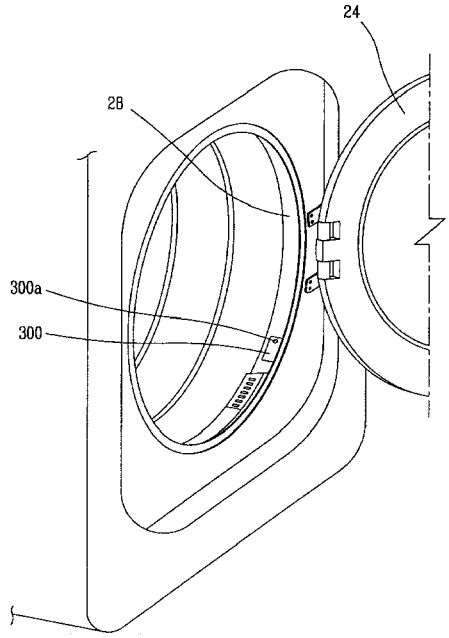
[Fig. 12]
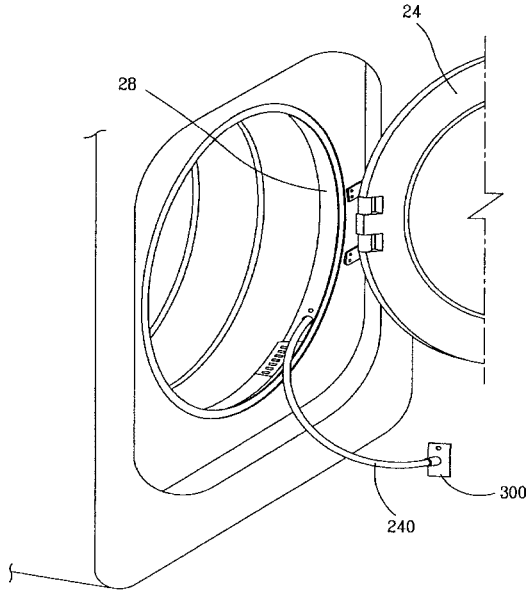
[Fig. 13]
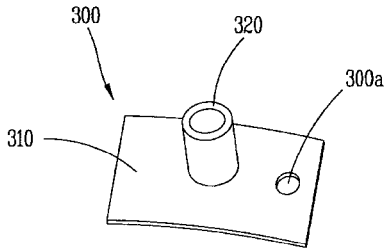

CLOTHES DRYER PROVIDED WITH SCENT-SUPPLY MODULE IN A TOP PLATE

This application is a 35 U.S.C. §371 National Stage entry of International Application No. PCT/KR2009/004425, filed on Aug. 7, 2009, which claims the benefit of the earlier filing date and right of priority to Korean Application Nos. 10-2008-0077543, filed Aug. 7, 2008; 10-2008-0077546, filed Aug. 7, 2008 and 10-2008-0077554, filed Aug. 7, 2008, and U.S. Provisional Application Nos. 61/086,843, filed on Aug. 7, 2008, 61/086,847, filed on Aug. 7, 2008, and 61/136,024, filed on Aug. 7, 2008, the contents of which are hereby incorporated by reference herein in their entirety.

TECHNICAL FIELD

The present invention relates to a clothes dryer, particularly, to a clothes dryer having a fragrance supplying module which sprays fragrance into a drum of the clothes dryer at a top plate, and more particularly, to a discharge means having a sealing structure at an inlet unit of a fragrance supplying module, and capable of discharging stored fragrance to outside of the clothes dryer.

BACKGROUND ART

Generally, a clothes dryer indicates an apparatus for drying laundry having completely undergone a dehydration process after a washing process, by introducing the laundry into a drum of the clothes dryer, and by evaporating moisture inside the laundry by supplying hot blast into the drum.

The clothes dryer comprises a drum disposed in the clothes dryer and into which laundry is introduced, a driving motor for driving the drum, a blow fan for blowing air into the drum, and a heating means for heating the air introduced into the drum. The heating means may use high-temperature electric resistance heat generated by using an electric resistance, or combustion heat generated by combusting gas.

Air having been discharged from the drum contains moisture of the laundry inside the drum, thereby changing into high-temperature humid air. According to a method for processing the high-temperature humid air, the clothes dryer may be classified. More concretely, the clothes dryer is classified into a condensation type clothes dryer for condensing moisture inside high-temperature humid air by heat-exchanging the high-temperature humid air with external air through circulation in the clothes dryer without discharging the high-temperature humid air out of the clothes dryer, and an exhaustion type clothes dryer for directly discharging high-temperature humid air having passed through the drum to the outside.

In case of introducing the laundry having completely undergone a washing process at a washing machine into the clothes dryer, the laundry may have odor of washing water or a detergent even if moisture contained therein has been removed. Furthermore, odor of the laundry before the washing process may remain after a drying process. This may cause uncomfortable feeling to a user. In order to remove the odor and to provide fresh feeling to the user, it was required to supply a fragrant material into the drum.

When a fragrant material stored in a chamber so as to be supplied into the drum is used up, required is a structure to easily supplement a new fragrant material. Especially, when the fragrant material is liquid, the fragrant material may be dispersed out through an input portion. In case of discharging a fragrant material remaining in the fragrance supplying module to outside of the clothes dryer, for example, in case of replacing a type of a fragrant material to be supplied into the drum, or cleaning the fragrant supplying module where a fragrant material has been stored, required is a structure to easily discharge out the fragrant material.

DISCLOSURE OF THE INVENTION

Therefore, it is an object of the present invention to provide a fragrance supplying module, a means to spray fragrance into a drum of a clothes dryer capable of easily re-supplying fragrance or capable of being easily replaced, by being installed at a position to which a user can easily approach, capable of easily spraying liquid fragrance, and capable of preventing fragrance stored in the fragrance supplying module from being dispersed to outside by having a sealing means which shields inside of the fragrance supplying module from outside.

It is another object of the present invention to provide a clothes dryer capable of easily discharging a liquid fragrant material stored in a fragrance supplying module, and having a discharge means at a position to which a user can easily approach.

To achieve these and other advantages and in accordance with the purpose of the present invention, as embodied and broadly described herein, there is provided a clothes dryer, comprising: a body; a top plate disposed on upper part of the body; a drum rotatably installed in the body; and a fragrance supplying module mounted at the top plate, and configured to supply fragrance into the drum, wherein the fragrance supplying module further comprises a sealing means to minimize the leakage of the fragrant liquid therefrom.

The fragrance supplying module may comprise a chamber where a fragrant liquid is stored, and a cover configured to open and close the chamber, wherein the sealing means is implemented as a first protrusion having a ring shape and formed on an inner surface of the cover.

The cover may be coupled to a cover coupling portion mounted at a through hole of the top plate. An opening having a cylindrical shape and into which a fragrant liquid is sprayed may be formed on an upper surface of the chamber. And, the opening may have a tapered portion having a diameter gradually decreased towards a lower side.

The first protrusion may shield inside of the chamber from outside by contacting the tapered portion of the opening, and a second protrusion having a ring shape may be formed at the opening of the chamber in correspondence to the first protrusion having a ring shape.

The first protrusion and the second protrusion may be formed to have the same diameter such that they contact each other when the cover is closed. Also, an outer diameter of one of the first protrusion and the second protrusion may be formed to be larger than an inner diameter of another such that they are forcibly fitted when the cover is closed.

The fragrance supplying module may further comprise a pump connected to the chamber, and a nozzle connected to the pump by a tube and configured to spray fragrance into the drum.

According to another aspect of the present invention, there is provided a clothes dryer, comprising: a body; a top plate disposed on upper part of the body; a drum rotatably installed in the body; and a fragrance supplying module mounted at the top plate, and configured to supply fragrance into the drum, wherein a fragrant liquid drain hose configured to drain a fragrant liquid stored in the fragrance supplying module is provided at the fragrance supplying module.

One end of the fragrant liquid drain hose may be connected to a lower side of the chamber, and a drain cap may be detachably mounted to another end of the fragrant liquid drain hose.

The drain cap may consist of a hose inserting portion into which the fragrant liquid drain hose is inserted, and a mounting portion having a mounting groove. The mounting portion of the drain cap may be mounted to a front supporter, and an inner diameter of the hose inserting portion may be smaller than an outer diameter of the fragrant liquid drain hose.

The clothes dryer according to the present invention may have the following advantages.

Firstly, a fragrant liquid may be easily sprayed into the fragrance supplying module without leaking to outside, and leakage of the fragrance stored in the chamber may be minimized by the sealing means.

Secondly, fragrance remaining in the fragrance supplying module may be easily discharged out. Especially, since the discharge means is located at a position to which a user can easily approach, fragrance may be easily discharged out.

BRIEF DESCRIPTION OF THE DRAWINGS

FIG. 1 is a perspective view of a clothes dryer according to one preferred embodiment of the present invention;

FIG. 2 is a side sectional view of the clothes dryer of FIG. 1;

FIG. 3 is a perspective view of a steam generator mounted to the clothes dryer of FIG. 1;

FIG. 4 is a perspective view showing an inner side of a clothes dryer having a fragrance supplying module mounted thereto according to one preferred embodiment of the present invention;

FIG. 5 shows the clothes dryer of FIG. 4, which was viewed from another angle;

FIG. 6 is a view of an inlet unit of a fragrance supplying module according to one preferred embodiment of the present invention;

FIG. 7 is a sectional view taken along line 'I-I' in FIG. 6;

FIG. 8 is a view an inlet unit of a fragrance supplying module according to another preferred embodiment of the present invention;

FIG. 9 is a view an inlet unit of a fragrance supplying module according to still another preferred embodiment of the present invention;

FIG. 10 is a sectional view of FIG. 9;

FIG. 11 is a view of a front supporter to which a drain cap of a fragrant liquid drain hose has been mounted according to the present invention;

FIG. 12 is a view showing a detached state of the drain cap; and

FIG. 13 is a perspective view of the drain cap of FIG. 11.

MODES FOR CARRYING OUT THE PREFERRED EMBODIMENTS

Reference will now be made in detail to the preferred embodiments of the present invention, examples of which are illustrated in the accompanying drawings.

Hereinafter, a clothes dryer according to the present invention will be explained in more detail.

Referring to FIGS. 1 and 2, the clothes dryer 10 according to the present invention comprises a front cover 11 which forms the appearance, a rear cover 12, a top plate 13, and a drum 15 into which laundry is introduced. The clothes dryer 10 comprises a front supporter 28 mounted to a rear surface of the front cover 11 and supporting a front opening of the drum 15, a door 24 mounted to a front surface of the front cover 11 and configured to open and close the opening of the drum 15, and a control panel 14 provided at an upper side of the front cover 11 and having each kind of buttons for inputting drying conditions.

The clothes dryer further comprises a drying fan 19 configured to make air inside the drum 15 circulate in the clothes dryer 10, a drying duct 17 configured to guide circulation air having passed through the drying drum 15 by the drying fan 19 to be introduced into the drum 15, a heater 18 disposed in the drying duct 17 and configured to heat air introduced into the drum 15, and a steam generator 100 disposed at an outer side of the drum 15 and configured to generate steam.

Below the drum 15, further comprised are a base 23 having a flow path of circulation air (A) and a flow path of external air (B) which performs heat exchange with the circulation air, a driving motor 20 mounted on an upper part of the base 23 and configured to drive the drum 15, a belt 16 configured to transmit a rotation force generated by the driving motor 20 to the drum 15, a cooling fan 22 connected to a motor shaft 21 of the driving motor 20 and configured to suck indoor air, and a condenser 26 mounted at an inner side of the base 23 and configured to heat-exchanging the external air (B) with the circulation air (A).

FIG. 3 is a perspective view of the steam generator 100 of the clothes dryer. The steam generator 100 includes a water supplying hose 110 configured to supply water having a room temperature, a steam generator body 150 configured to store water supplied thereto, a heater (not shown) disposed in the steam generator body 150 and configured to heat the stored water, a discharge hose 120 configured to discharge steam generated from the steam generator body 150, and a steam nozzle 121 connected to the end of the discharge hose 120. Under these configurations, water having been supplied to the steam generator body 150 through the water supplying hose 110 is heated by the heater, and then is discharged to the discharge hose 120. And, the discharged steam is sprayed into the drum 15 through the steam nozzle 121.

FIG. 4 is a perspective view showing an inner side of the clothes dryer having a fragrance supplying module mounted thereto according to a first embodiment of the present invention, and FIG. 5 shows the clothes dryer of FIG. 4, which was viewed from another angle.

For convenience, FIGS. 4 and 5 illustrate only the top plate 13, the drum 15, the front supporter 28, and the fragrance supplying module.

The fragrance supplying module according to one preferred embodiment of the present invention is mounted to one side of the top plate 13, and supplies fragrance into the drum 15. The fragrance supply module includes a chamber configured to store a fragrant liquid therein, a cover unit configured to open and close the chamber, a pump connected to the chamber, and a nozzle connected to the pump by a tube and configured to spray the fragrant liquid into the drum.

The top plate 13 is provided with a through hole for mounting the fragrance supplying module, and the fragrance supplying module is mounted to the through hole.

More concretely, the cover unit includes a cover 200 configured to open and close the chamber 220 of the fragrance supplying module, and a cover coupling portion 210 configured to couple the cover 200. The cover coupling portion 210 is mounted to the through hole of the top plate 13 by coupling means such as screws or hooks. The cover 200 of the cover unit is coupled to one side of the cover coupling portion 210 by a hinge. And, coupling means configured to open and close the cover 200 are provided at another side of the cover coupling portion 210. Preferably, the coupling means are implemented as a hook 213 of the cover 200, and a hook locker 214 of the cover coupling portion 210.

When supplying a fragrant liquid to the fragrance supplying module, the cover 200 is opened. However, when the supply of the fragrant liquid to the fragrance supplying module is completed, the cover 200 is closed to prevent the fragrant liquid stored in the chamber from leaking out by evaporation. Preferably, a sealing member (not shown) for sealing is provided between the cover unit and the chamber so as to more surely prevent the leakage of the fragrant liquid.

The pump 230 is attached to a side surface of the chamber 220, and the chamber 220 and the pump 230 are connected to each other by a hose. Fragrance stored in the chamber is introduced into the pump by a hose, and is compressed by the pump thus to be transmitted to a nozzle 260. Then, the fragrance is sprayed into the drum. Preferably, an outlet of the nozzle is installed at a front supporter or a rear supporter towards the inside of the drum.

A fragrant liquid drain hose 240 configured to drain a fragrant liquid may be mounted below the chamber 220. When replacing a fragrant liquid stored in the chamber 220 by a new one, or when completely removing the fragrant liquid stored in the chamber 220 for cleaning, the fragrant liquid drain hose 240 may be used. The fragrant liquid drain hose 240 has a structure that its end is closed at ordinary times, but is opened only when draining fragrance. Preferably, the fragrant liquid drain hose 240 is extendingly-installed towards a downward direction, and the end thereof is attached to a lower component of the clothes dryer.

In the chamber 220, may be disposed a level sensor 222 configured to measure the amount of a fragrant liquid stored in the chamber 220. The level sensor 222 may be an electrode sensor, or a reed switch for sensing a magnetic pole of a magnet. The present invention may be also provided with a means for informing a user that the amount of a fragrant liquid inside the chamber 220 is not sufficient. Preferably, the means is installed at a control panel disposed on a front surface of the clothes dryer.

Preferably, a sealing means is provided between the cover 200 and the chamber 220, thereby shielding the inside of the fragrance supplying module from the outside. The reason is in order to prevent a fragrant liquid stored in the fragrance supplying module from being dispersed to the outside by evaporation.

In the present invention according to one preferred embodiment, an inlet unit of the fragrance supplying module mounted to the top plate is provided with a sealing means for preventing fragrance from being dispersed to the outside. FIGS. 6 to 10 are views showing different types of inlet units of the fragrance supplying module according to various embodiments of the present invention.

Referring to FIGS. 6 and 7, in order to prevent a fragrant liquid stored in the chamber 220 of the fragrance supplying module from being dispersed to the outside, a first protrusion 200*a* having a ring shape and formed on an inner surface of the cover 200 serves as a sealing means. For this, the first protrusion 200*a* is formed of a material having elasticity.

The top plate 13 is provided with a through hole for mounting the cover coupling portion 210, and the cover 200 is coupled to the cover coupling portion 210. An opening through which fragrance is introduced is formed on an upper surface of the chamber 220. And, the opening has a tapered portion 220*a* having a diameter gradually decreased towards a downward direction. The upper surface of the chamber 220 includes a top portion 220*c* connecting the tapered portion 220*a* with the chamber 220. The top portion 220*c* contacts a bottom surface of the cover coupling portion 210. Also, the opening has an extended portion 220*b* extended with the same diameter at the lowest part. Once the cover 200 is closed towards the cover coupling portion 210, the ring-shaped first protrusion 200*a* of the cover 200 comes in contact with the tapered portion 220*a* of the opening, thereby shielding the inside of the chamber from the outside.

FIG. 8 is a view showing an inlet unit of the fragrance supplying module according to another preferred embodiment of the present invention, in which a cover 200' and a guide portion 210' are formed to have round shapes. When the cover 200' and the guide portion 210' are formed to have round shapes, the first protrusion of the cover is more smoothly adhered to the tapered portion, thereby enhancing the sealing efficiency. Detailed descriptions thereof are similar to the aforementioned descriptions, and thus their explanations will be omitted.

According to another preferred embodiment, the ring-shaped first protrusion 200*a* of the cover 200 may be inserted into the extended portion 220*b* of the opening in a state that the cover has been closed, thereby shielding the inside of the fragrance supplying module from the outside. For this, a protruded length of the first protrusion has to be determined with consideration of a depth of the extended portion of the opening.

FIGS. 9 and 10 are views showing an inlet unit of the fragrance supplying module according to still another preferred embodiment of the present invention.

Referring to FIGS. 9 and 10, the first protrusion 200*a* is formed at the cover 200, and an opening 221 having a cylindrical shape is formed on an upper surface of the chamber 220. And, a second protrusion 221*a* having a ring shape is formed at the opening 221. The second protrusion 221*a* is formed in correspondence to the ring-shaped first protrusion 200*a* of the cover 200. Once the cover 200 is closed towards the opening 221 formed on an upper surface of the chamber 220, the first protrusion 200*a* and the second protrusion 221*a* come in contact with each other, thereby shielding the inside of the fragrance supplying module from the outside. That is, one of the first and second protrusions has an outer diameter slightly larger than an inner diameter of another of the first and second protrusions. Under this configuration, when the cover is closed, an outer diameter of one of the first and second protrusions is forcibly fitted into an inner diameter of another of the first and second protrusions, thereby sealing the inside of the fragrance supplying module from the outside. For this, at least one of the first and second protrusions is formed of a material having elasticity.

Alternatively, the first protrusion 200*a* and the second protrusion 221*a* may be formed to have the same diameter. In this case, once the cover 200 is closed, the first protrusion 200*a* and the second protrusion 221*a* come in contact with each other. Accordingly, the inside of the chamber of the fragrance supplying module is shielded from the outside.

FIG. 11 is a view showing a front supporter to which a drain cap of a fragrant liquid drain hose according to one preferred embodiment of the present invention has been mounted, which shows an opened door. FIG. 12 is a view showing the front supporter from which the drain cap has been detached, and FIG. 13 is a perspective view of the drain cap of FIG. 11.

Hereinafter, the fragrant liquid drain hose 240 will be explained with reference to the attached drawings.

Preferably, the fragrant liquid drain hose 240 is implemented in the form of a tube having a small diameter, and has a sufficient length. Also, the fragrant liquid drain hose 240 is preferably formed of material having good flexibility. One end of the fragrant liquid drain hose 240 is connected to a lower side of the chamber 220, and another end thereof is mounted with a drain cap 300. The drain cap 300 is detachably mounted to the fragrant liquid drain hose 240. That is, the drain cap 300 consists of a hose inserting portion 320 configured to insert the fragrant liquid drain hose, and a mounting portion 310 configured to mount the drain cap 300 to the clothes dryer. The mounting portion 310 is provided with a mounting groove 300*a* for mounting.

The drain cap 300 is mounted to a side surface of the front supporter 28 so as to enhance a user's accessibility. Referring to FIG. 11, the drain cap 300 is mounted to one side surface of the front supporter 28 of the clothes dryer. In the preferred embodiment, the drain cap 300 is fixed to the front supporter by inserting a screw into the mounting groove 300*a*.

FIG. 12 shows that a fragrant liquid stored in the fragrance supplying module is discharged, which shows that the drain cap has been detached from the front supporter by removing a screw mounted to the drain cap 300. Here, an outlet of the fragrant liquid drain hose 240 is blocked by the drain cap 300. Once a user detaches the drain cap 300 attached to the end of the fragrant liquid drain hose 240, a fragrant liquid stored in the fragrant liquid drain hose 240 is naturally drained by gravity. Furthermore, since the chamber 220 is located at a position higher than the fragrant liquid drain hose, a fragrant liquid stored in the chamber 220 is also naturally drained by gravity. Accordingly, the inside of the chamber 220 is made to be completely empty. The fragrant liquid drain hose is re-inserted into the drain cap, and then the drain cap is mounted to the front supporter for reuse.

As the drain cap is mounted to the front supporter, the user can easily open the door of the clothes dryer. The hose inserting portion 320 configured to insert the fragrant liquid drain hose 240 has an inner diameter smaller than an outer diameter of the fragrant liquid drain hose 240. Accordingly, the fragrant liquid drain hose 240 is forcibly fitted into the hose inserting portion 320, thereby being mounted to the drain cap without having leakage of a fragrant liquid therein.

Hereinafter, will be briefly explained a process for performing a drying process with spraying fragrance to the drum 15 inside the clothes dryer 10.

Firstly, a user opens the door 24 to put laundry into the drum 15, and then inputs a drying course with fragrance spray through an input unit mounted on the control panel 14. Once the drying process starts, the driving motor 20 is operated. And, the belt wound on an outer circumferential surface of the drum 15 and the motor shaft 21 is rotated as the motor shaft 21 is rotated. Accordingly, the drum 15 is also rotated. Here, the cooling fan 22 and the drying fan 19 connected to the driving motor 20 are also driven, and the heater 18 mounted in the drying duct 17 heats air introduced into the drum 15. Steam generated from the steam generator 100 is sprayed into the drum 15 through the steam nozzle 121.

During a drying process, fragrance can be sprayed into the drum 15 together with the steam spraying process. In the present invention, a fragrant liquid introduced into the chamber 220 under guide of the guide portion 210 of the inlet unit is stored in the chamber 220. Then, the fragrant liquid is compressed by the pump 230 when necessary, thereby being sprayed into the drum 15 through the nozzle 260 in the form of mists. The time to spray the fragrant liquid may be manually controlled by a user's manipulation of the control panel, or may be automatically controlled by a microprocessor. In the case of the latter automatic control, a user selects his or her desired drying course among a plurality of pre-programmed drying courses on the control panel. According to the selected drying course, the time to spray the fragrant liquid is automatically controlled by a microprocessor.

Once the fragrant liquid stored in the fragrance supplying module is used up after the clothes dryer has performed drying processes a plurality of times, a level sensor implemented as an electrode sensor or a magnetic sensor for measuring the amount of the fragrant liquid stored in the chamber 220 detects the insufficient state of the fragrant liquid. As the level sensor transmits the information to the microprocessor, the microprocessor may generate a signal informing the insufficient state of the fragrant liquid to a user. Accordingly, the user opens the cover 200 of the inlet unit mounted to the top plate 13 of the clothes dryer, and sprays a fragrant liquid into the opening 221 of the chamber 220, thereby conveniently supplying the fragrant liquid into the chamber 220 for supplementation. And, once the cover 200 is closed after the fragrance spray process is completed, the first protrusion protrudingly formed at the cover comes in contact with the tapered portion or the extended portion of the chamber, or the second protrusion of the opening. Accordingly, the inside of the fragrance supplying module is sealed from the outside.

When replacing the fragrant liquid to be supplied to the drum by a new one, or when the fragrance supplying module having fragrance stored therein is to be cleaned, the fragrant liquid remaining in the chamber need to be discharged out of the clothes dryer. In the present invention, the remaining fragrant liquid may be easily discharged out by using the fragrant liquid drain hose connected to a lower side of the chamber. More concretely, the fragrant liquid remaining in the chamber and the fragrant liquid drain hose may be easily discharged out by separating the drain cap connected to the end of the fragrant liquid drain hose from the clothes dryer, and then by removing the drain cap from the end of the fragrant liquid drain hose.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A clothes dryer, comprising:

a body;

a top plate having a through hole, and disposed on an upper part of the body;

a drum rotatably installed in the body; and a fragrance supplying module mounted at the top plate, and to supply fragrance into the drum, wherein the fragrance supplying module comprises:

a chamber having a space where a fragrant liquid is stored, wherein the chamber includes an opening formed at an upper surface of the chamber for the fragrant liquid to be poured into the space, thereby the opening is fluidly connected to the through hole, wherein the chamber includes a taper portion formed to have a diameter gradually decreased from the opening toward a lower side, a cover rotatably coupled to a circumferential portion of the through hole, thereby the cover configured to open and close the opening of the chamber, and a first protrusion having a ring shape and formed downward from an inner surface of the cover, a cover coupling portion mounting the cover at the through hole of the top plate, wherein the cover coupling portion surrounds an outer periphery of the cover to hold the cover, a top portion of the upper surface of the chamber contacts a bottom surface of the cover coupling portion, and the first protrusion is contained within the chamber through the opening and pressurized onto the taper portion by rotating the cover from a top surface of the cover downward to close the opening and thereby sealing the opening, wherein a hook locker is provided at a portion of periphery of the cover coupling portion, and wherein a hook is formed at a portion of periphery of the cover and is coupled into the hook locker when the cover is closed.

2. The clothes dryer of claim 1, wherein the fragrance supplying module further comprises:

a pump connected to the chamber; and a nozzle connected to the pump by a tube to spray fragrance into the drum.

* * * * *